US007060910B2

(12) United States Patent
Wussow et al.

(10) Patent No.: US 7,060,910 B2
(45) Date of Patent: Jun. 13, 2006

(54) ATTACHMENT SYSTEM FOR AN ELECTRICAL DEVICE FOR INSTALLATION IN AIRCRAFT CABINS

(75) Inventors: Burghard Wussow, Hamburg (DE); Uwe Piskrzynski, Guderhandviertel (DE)

(73) Assignee: Airbus Deutschland GmbH (DE)

( * ) Notice: Subject to any disclaimer, the term of this patent is extended or adjusted under 35 U.S.C. 154(b) by 0 days.

(21) Appl. No.: 11/206,619

(22) Filed: Aug. 18, 2005

(65) Prior Publication Data

US 2006/0037775 A1 Feb. 23, 2006

Related U.S. Application Data

(60) Provisional application No. 60/602,373, filed on Aug. 18, 2004.

(30) Foreign Application Priority Data

Aug. 18, 2004 (DE) ..... 10 2004 040 029

(51) Int. Cl.
*H01R 33/00* (2006.01)

(52) U.S. Cl. ..... 174/138 G; 174/135; 439/358; 439/357; 439/372; 439/373; 439/351; 439/350

(58) Field of Classification Search ..... 174/138 G, 174/135; 439/358, 357, 372, 373, 351, 350
See application file for complete search history.

(56) References Cited

U.S. PATENT DOCUMENTS

| | | | | |
|---|---|---|---|---|
| 5,197,900 | A * | 3/1993 | Ellis et al. | 439/352 |
| 5,795,175 | A * | 8/1998 | Barr | 439/358 |
| 6,115,244 | A * | 9/2000 | Chen et al. | 361/684 |
| 6,953,361 | B1 * | 10/2005 | Li et al. | 439/358 |
| 2003/0060067 | A1 | 3/2003 | Kerr, Jr. | 439/180 |

FOREIGN PATENT DOCUMENTS

DE 199 61 708 C1 8/2001

* cited by examiner

*Primary Examiner*—Jinhee Lee
(74) *Attorney, Agent, or Firm*—Ostrolenk, Faber, Gerb & Soffen, LLP

(57) ABSTRACT

The invention relates to an attachment system for an electrical device for installation in aircraft cabins, including a base component to be installed so as to be fixed; with a multi-pole supply connector unit, prepared for connection to various electrical supply lines, as a base; attachment means affixed to the base component; a housing component that is to be detachably attached, which is designed for accommodating the electrical device with at least one electrical consumer; a housing connector unit connected to the electrical consumer, of which there is at least one, by way of electrical lines, which housing connector unit is affixed to the housing component so as to be complementary to the supply connector unit; and attachment means affixed to the housing component, which attachment means automatically connect to the attachment means affixed to the base component when the complementary connector units are plugged into each other.

9 Claims, 6 Drawing Sheets

ATTACHMENT SYSTEM FOR AN ELECTRICAL DEVICE FOR INSTALLATION IN AIRCRAFT CABINS

REFERENCE TO RELATED APPLICATIONS

Figure 1:
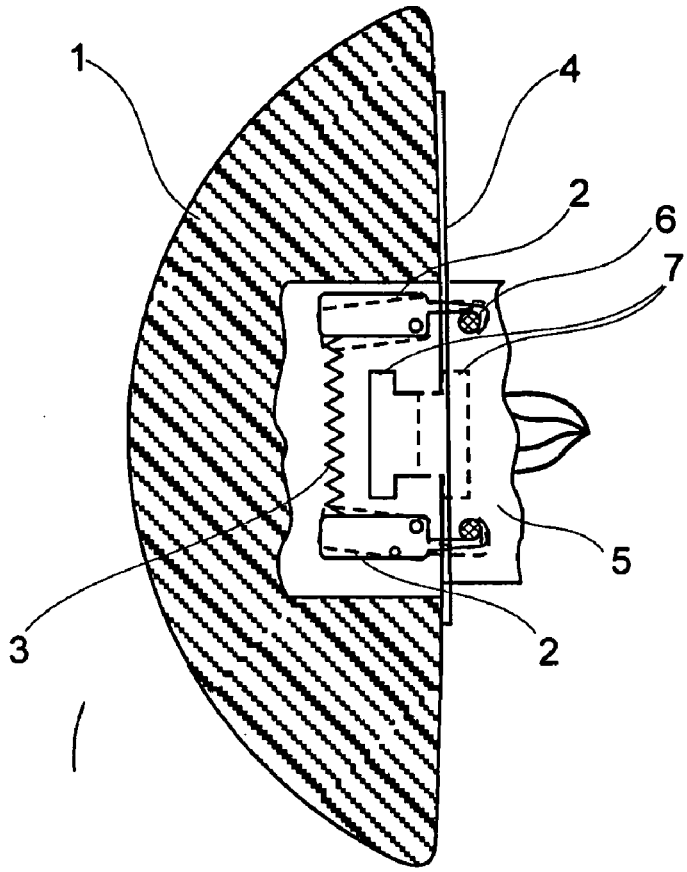

This application claims the benefit of the filing date of U.S. Provisional Patent Application No. 60/602,373 filed Aug. 18, 2005, and of German Patent Application No. 10 2004 040 029.6 filed Aug. 18, 2005, the disclosures of which are hereby incorporated herein by reference.

FIELD OF THE INVENTION

The present invention relates to an attachment system for an electrical device for installation in aircraft cabins. Particularly, the invention relates to such attachment systems that can be used wherever, during fitting of interior equipment in aircraft, initially quick installation and later simple, safe and quick exchangeability of the installed devices in the case of maintenance are desired.

TECHNOLOGICAL BACKGROUND

Interior equipements of aircraft include numerous electrical devices that have to be fixed into place, some of which devices are provided as prefabricated units. The installation effort essentially arises from the necessary connection to electrical supply lines and from attachment of the device at the intended installation location.

The so-called exit signs, small lamp assemblies comprising lighting means, which signs serve as marker lights for cabin exits and for escape routes, and which in the case of the aircraft sustaining damage also act as emergency lighting, are one group of such electrical devices.

Exit signs are part of the safety-relevant assemblies in an aircraft. They are checked daily as part of pre-start checks. If any deficiencies or malfunctions are detected, the operational readiness of such assemblies must be restored completely before the aircraft is allowed to take off.

Normally, when the cabin is fitted out, various electrical devices, in particular exit signs, are connected to electrical supply lines that have already been installed earlier. In order to have the installation freedom necessary for this, the lines have to have a certain overlength if they have been installed in hollow spaces which are difficult to access.

Following a different practice in the installation of electrical devices, at present first the device is mechanically installed, and thereafter the electrical connections are established by way of individual plug-type contacts.

Both the above approaches are associated with a number of disadvantages. The phase of cabin fitout requires considerable installation effort because the devices have to be attached at the intended installation location, for example by means of screw connections, and by the allocation and connection of numerous (mostly one-pole) plug-type connections for electrically connecting the devices.

As a result of the overlength of the supply lines, which overlength is required for connecting the complete devices, after installation a superfluous line part remains in the region where the supply lines have been installed. This superfluous line part carries the danger of uncontrolled movement and uncertain line routing of the supply lines, as a result of which the danger of chafing arises. In order to prevent damaging the insulation of the cables, expensive chafing protection is thus required, and/or options must be found for attaching the relatively loosely placed cables again after completion of device installation.

Maintenance measures require considerable installation effort because even in the case of exchanging individual components, deinstallation and renewed connection of the device may become necessary. In the context of renewed separation and connection of the individual plug-type connections, any maintenance measure entails a danger of mixing up the connectors, which requires additional troubleshooting and remedial action.

Conventional installation requires the use of various tools and a multitude of loose components, for example screws and various shim components. These have to be kept in stock at the location where maintenance may become necessary. Especially in the case of exit signs this is an additional disadvantage in that exchange of these safety-relevant components must be able to be carried out practically anywhere.

Adapting the electrical devices to be installed to the requirements of the place of installation can result in a considerable increase in the weight of the devices when installation is to take place by integration in other assemblies and when such integration requires adaptive constructive measures. Extensive integration also increases production costs.

There may be a need for an attachment system for an electrical device, which provides easy installation of electrical devices in the cabin region of aircraft.

SUMMARY OF THE INVENTION

The need may be met by an attachment system according to the invention with the characteristics of claim 1. Advantageous embodiments of such devices are mentioned in dependent claims 2 to 10.

In an exemplary embodiment of the present invention an attachment system is based on a two-component design of the electrical devices to be installed. One component comprises a base component that is to be installed so as to be fixed, which base component can be affixed with normal attachment means to a place of installation, for example to a cabin wall. This base component comprises a connector unit which comprises an adequate number of poles to be able to accommodate all supply lines required for supplying the electrical device to be installed. In this way all supply lines can end at the connector unit. The second component comprises an actual housing of the electrical device to be installed, at which component there is a connector unit that is complementary to the connector unit of the base component. Both components comprise attachment means which make possible fast interconnection of the two components in that the attachment means can be made to engage each other. Various forms of quick-acting closures and spring-loaded disconnecting mechanisms are suitable as attachment means.

Both the electrical device in the housing component and the securely installed counterpiece in the form of the base component comprise a firmly installed connector from which all the required cables and supply lines lead away. As a rule on completion of installation, and/or after the initial installation, the connection between the connectors and the electrical lines leading away from said connectors does not have to be separated.

In an exemplary embodiment the invention may comprise or may consists of an attachment system for an electrical device for installation in aircraft cabins, which attachment system may comprises a base component, to be installed so as to be fixed, with a multi-pole supply connector unit, prepared for connection to various electrical supply lines, as a base; and further may comprise attachment means affixed to the base component; a housing component that is to be detachably attached, for accommodating the electrical device, which housing component comprises at least one electrical consumer; a housing connector unit connected to said electrical consumer by way of electrical lines, which housing connector unit is affixed to the housing component so as to be complementary to the supply connector unit; and attachment means affixed to the housing component, which attachment means automatically connect to the attachment means affixed to the base component when the complementary connector units are plugged into each other.

In this way by plugging the complementary connector units into each other, further provisions for mechanical locking automatically may become superfluous. It may be particularly advantageous if the attachment means are suitable for establishing a positive locking (form-fit) connection. This may for example be achieved in that the attachment means comprise a fixed contour that can be gripped from the back. A particularly advantageous attachment system that may be gripped from the back results if the attachment means on the base component may comprise stud bolts whose axes extend across the plug-in direction of the housing component, and if the attachment means may comprise claws that are swivellable on the housing component, which claws can be swivelled away against the restoring force of a stretched spring. With such a system according to the invention automatic mechanical locking may be achieved in a particularly simple way, in particular if, in the installed state, the swivellable claws are held by the stretched spring so that said claws engage the stud bolts.

Particularly simple and convenient installation of the electrical device may result if the housing connector unit comprises a protruding spout which when the complementary connector units are plugged into each other during installation may cause guidance of the movement of the housing component in the direction towards the base component, in the installed state may form an end stop, and telescopically may enclose the supply connector unit.

A particularly robust attachment, and secure against inadvertent undoing, of the electrical device may result if in the installed state the swivellable claws may completely grip the stud bolts from the back, and for undoing the housing component a targeted unlocking of the connection between stud bolts and claws may has to take place.

In order to increase the convenience during service and maintenance activities it may be advantageous if the swivellable claws in the installed state incompletely grip the stud bolts from the back, and if during undoing of the housing component above a specified pull-off force, automatic unlocking of the connection between stud bolts and claws may take place. The required pull-off force may be adjusted without any problem by way of the geometry of the swivellable claws and the spring constant of the spring, which keeps the claws engaged with the stud bolts. Consequently, in this way too, adaptation of the attachment system to the sometimes considerable acceleration that can occur in aircraft operation may take place without compromising safety.

By mechanically installing the devices, as a result of the arrangement of the complementary electrical connector units and the shape of the plug-type contacts, the electrical connection to the device may also established at the same time. No further steps to establish electrical contact to the device may be necessary. The individual plug-type contacts may be preferably formed as pairs of a pin and an associated socket. The issue as to which connector unit is to comprise pins and which connector unit is to comprise sockets may not significant in the context of the invention. The installation effort may be reduced in every case because the steps required for mechanical installation and electrical connection by means of individual plug-type contacts may have been replaced by the single step of "clicking in". If deinstallation is required, this no longer necessitates the removal of numerous screw connections and the pulling off of individual electrical contacts or numerous plug-type connections.

In many applications it may be advantageous if the complementary connector units are designed in two rows and incorporate at least eight poles. Larger numbers of poles may be implemented without any problem. Apart from simple connection of multi-pole consumers this may open up an advantageous robust connector geometry which may even suitable for accommodating loads, and which may support the already mentioned guided movement during attachment of the electric device in a way that there may be essentially no need to provide further guiding means.

Because of the securely installed connectors not only in the device but also in the counterpart it may be possible to implement a fixed routing of lines. The hitherto required overlength of the connection cables for connecting the electrical devices may become superfluous as a result of this. Any uncontrolled line routing, which previously could result in chafing spots, may thus be prevented. There may no longer be a need to provide mechanical protection against chafing.

Because preassembled connectors are now used, already-tested connections may be installed in the aircraft. This may obviate the need for special effort in troubleshooting in the aircraft.

As a result of the principle according to the invention, which may involve mechanical and electrical coupling at the same time, the production effort may clearly reduced both as far as the installation times and any remedial work that may be needed is concerned. Uniformly two simply-to-prepare and lightweight components may to be installed, which may result in savings of weight and expenditure.

All the described advantages of the invention may be implemented in an outstanding manner if the housing component is an exit sign.

Figure 2:
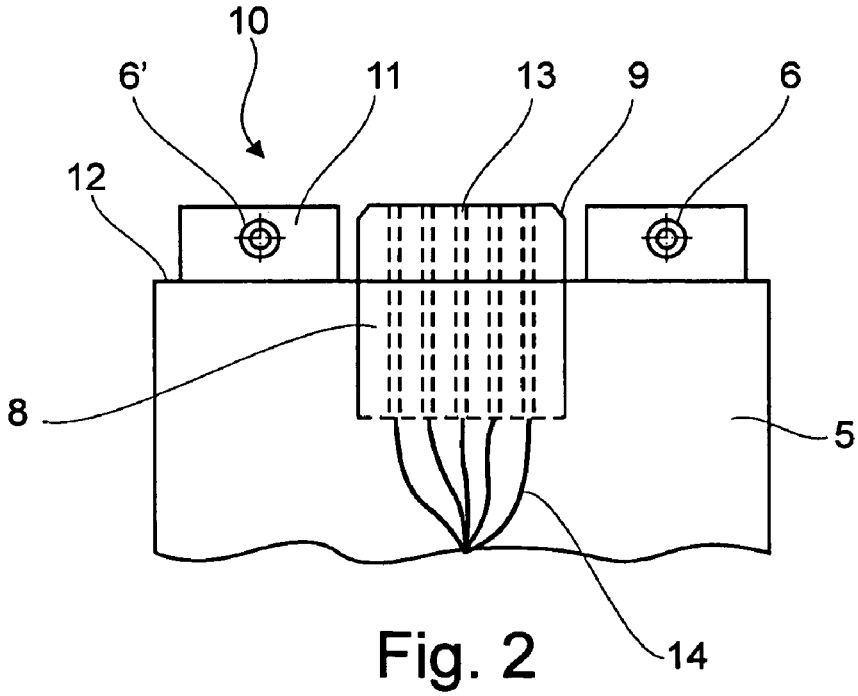
Figure 3:
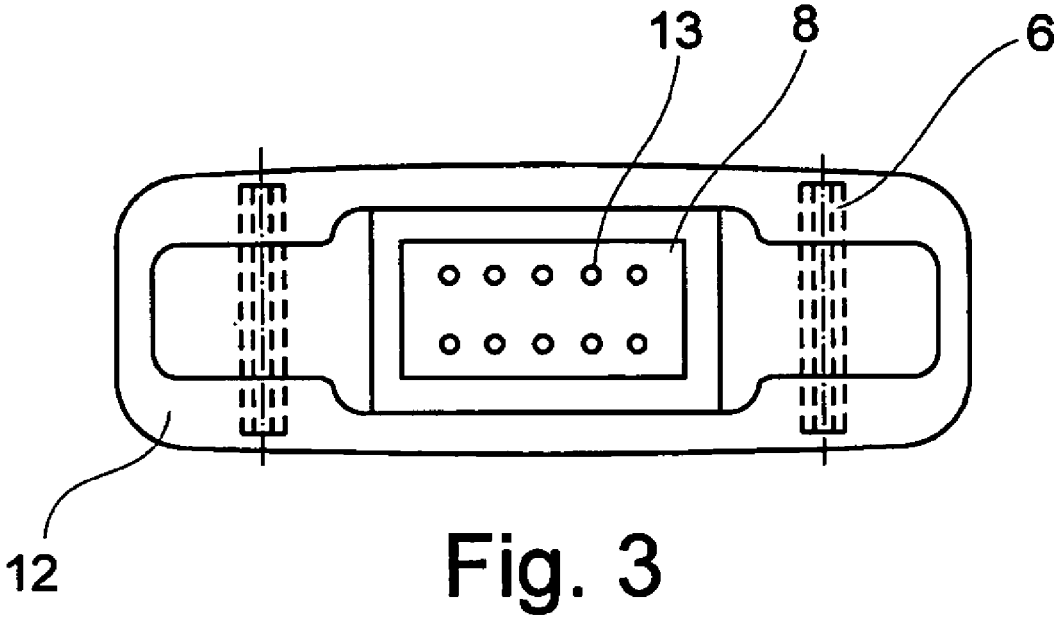
Figure 4:
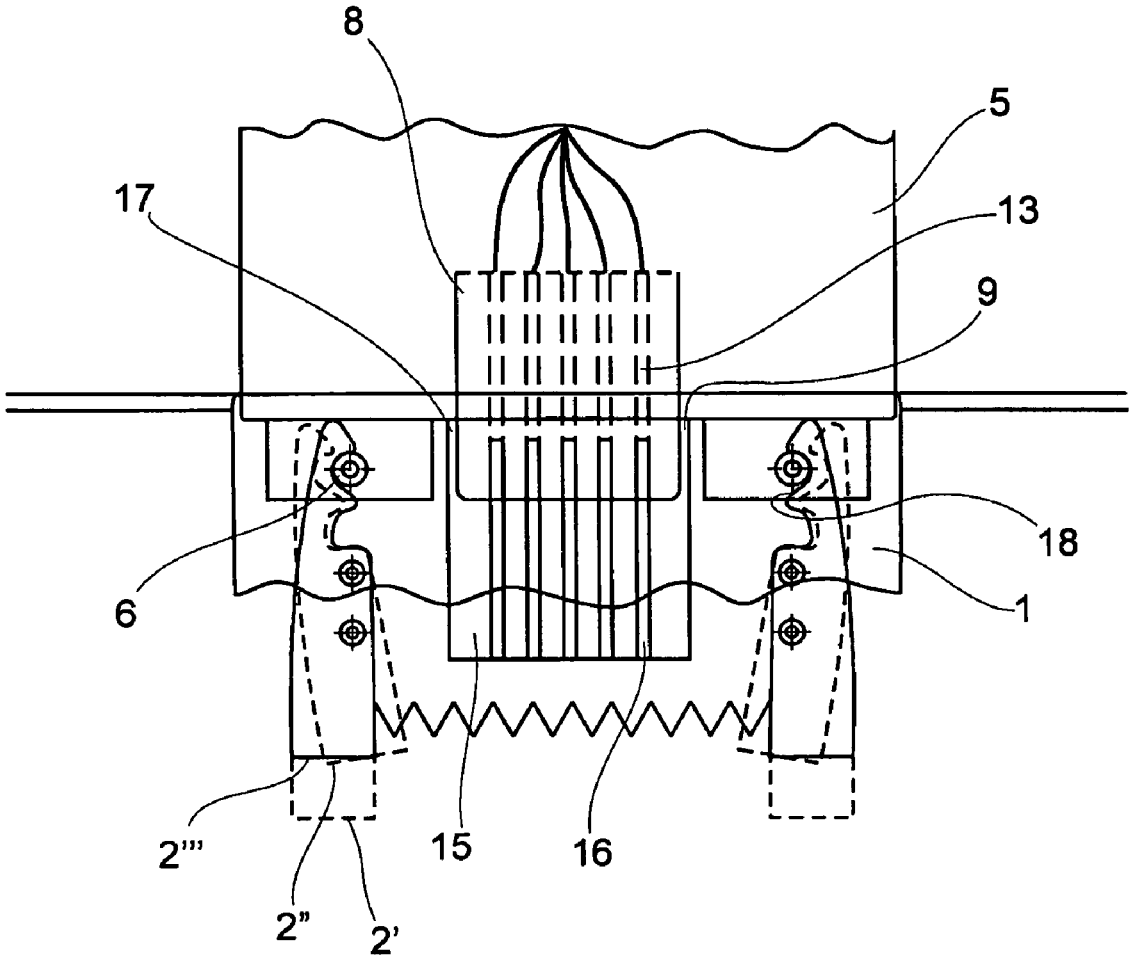
Figure 5:
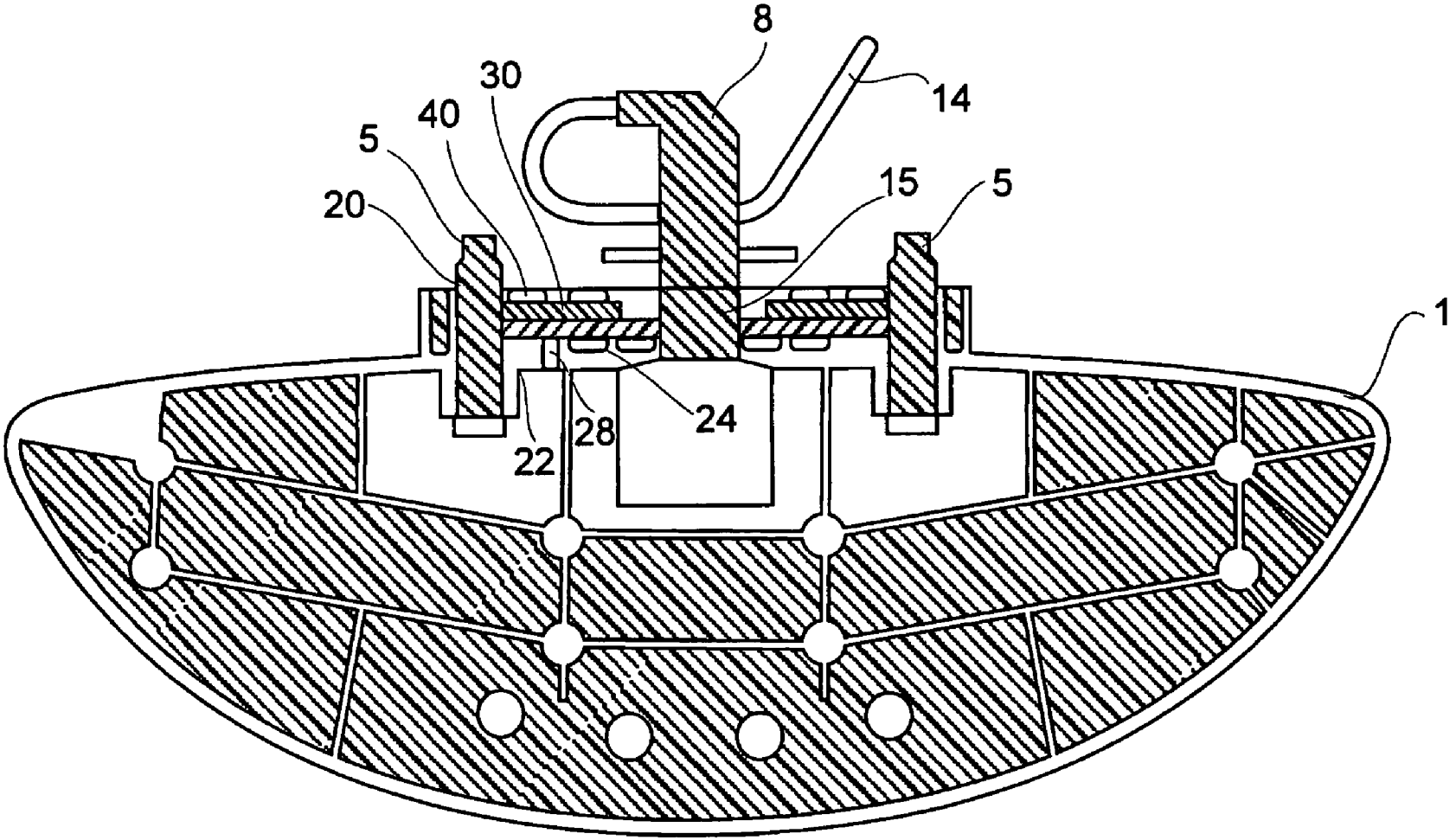
Figure 6:
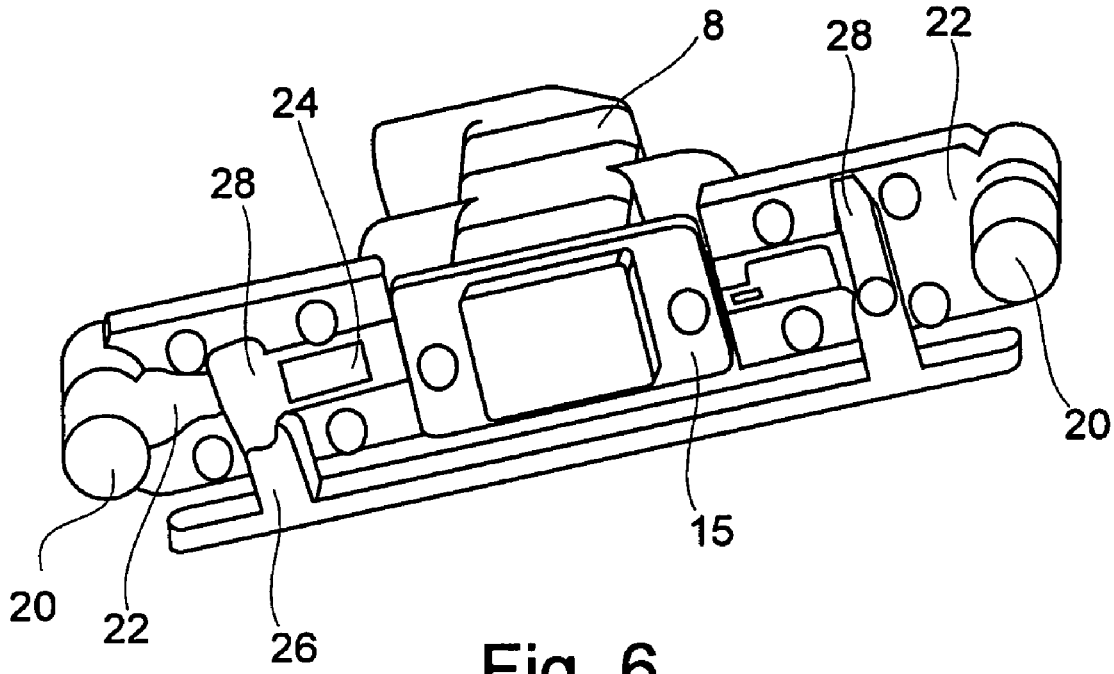
Figure 7:
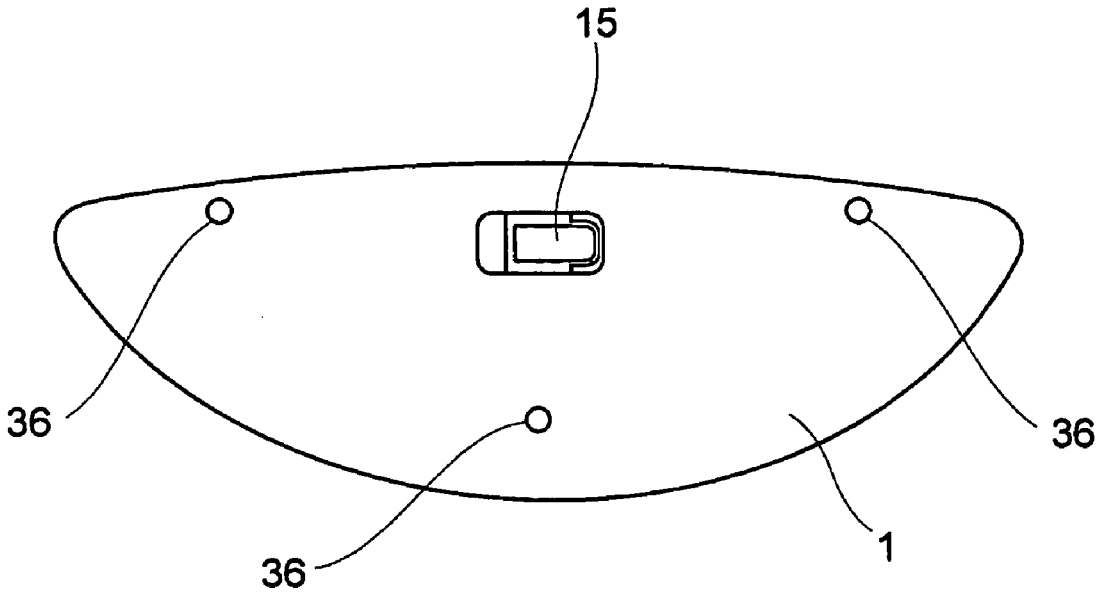
Figure 8:
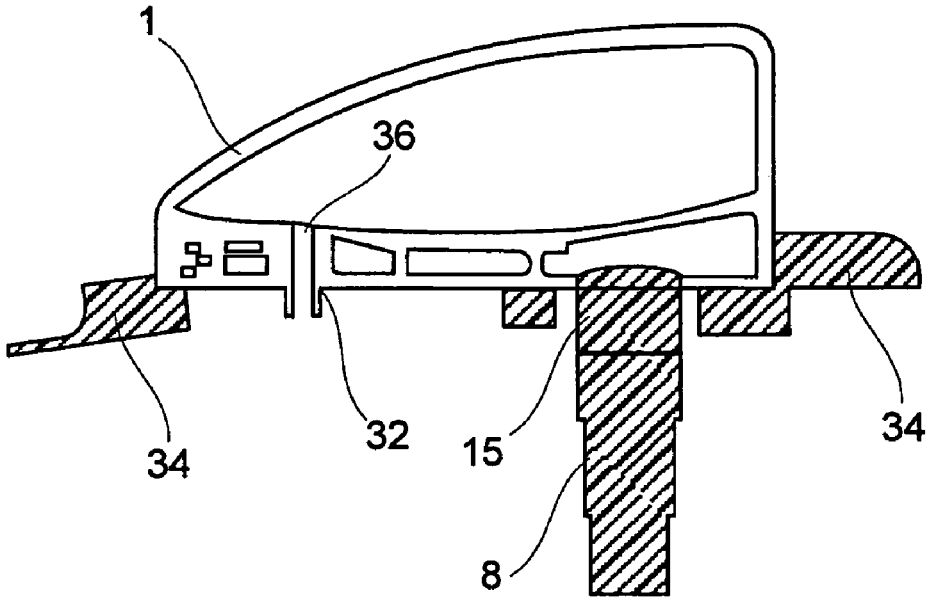

Below, the invention is explained in more detail using the example of an embodiment of an exit sign. The following are shown:

FIG. 1 a diagrammatic overview of an exit sign according to the invention, in its fully assembled state;

FIG. 2 a lateral view of a section of a base component according to the invention;

FIG. 3 a top view of a section of a base component according to the invention;

FIG. 4 an enlarged view of an interconnectable assemblies;

FIG. 5 a section view of an arrangement of a housing component according to the invention, for ceiling installation, which housing component has been attached to a base component;

FIG. 6 a three-dimensional view of a closure mechanism of a housing component;

FIG. 7 a section view of an arrangement of a housing component, according to the invention, for wall installation, which housing component is attached to a base component; and FIG. 8 a cross-section view of a housing component installed on a wall.

DESCRIPTION OF PREFERRED EMBODIMENTS OF THE INVENTION

FIG. 1. The interior of a dome-shaped housing 1 of an exit sign comprises swivellable claws 2 which can be deflected against the restoring force of a stretched spring 3. At its margin a base component 5, installed to the cabin wall 4 so as to be fixed, comprises stud bolts 6, which are gripped from the back by the swivellable claws 2. In the centre region there is an interconnected pair of complementary connector units 7, which ensures the electrical connection between the base component and the housing component.

FIG. 2 shows a lateral view of a section of a base component 5 according to the invention, with a multi-pole supply connector unit 8, prepared for connection to various electrical supply lines, as a base, with a phase 9 to facilitate installation. The supply connector unit 8 is a ten-pole design. Nine poles are assigned. On the side of the supply connector unit 8 stud bolts 6 are connected to the base component 5, wherein the axes of said stud bolts 6 extend so as to be perpendicular in relation to the direction 10 of installation. The stud bolts are attached to supporting structures 11, which protrude from a support surface 12 which facilitates installation of the base component. In this way the stud bolts 6 provide a stationary contour, that can be gripped from the back, according to the invention. In the interior of the supply connector unit 8, contact sockets 13 are connected to supply lines 14.

FIG. 3 shows a top view of a section of a base component 5 according to the invention. The ten-pole supply connector unit 8 comprises a double row of contact sockets 13. The lateral position of the parts of the stud bolts 6, which parts are available for interaction by attachment means, is clearly shown. Dimensioning of the base component, in particular the design and positioning of the stud bolts 6 and the support surface 12, significantly contributes to the achievable stability of the completely installed arrangement. For example, FIG. 3 shows dimensions which have been shown to be particularly advantageous for installing exit signs. For this arrangement, round stud bolts 6 with a diameter of 6 mm, mutually spaced apart by 80 mm, have proven successful.

FIG. 4 shows an enlarged view of the interconnectable assemblies. With reference to three positions of the swivellable claws 2 the sequence of connecting the housing 1 to the base component 5 is explained in more detail. The housing 1 comprises a housing connector unit 15 which, complementary to the arrangement of the contact sockets 13 of the supply connector unit, comprises a ten-pole two-row arrangement of contact pins 16. The arrangement of the contact pins 16 is enclosed by a protruding spout 17 which, when the complementary connector units are plugged together during installation, cause the movement of the housing component to be guided, in the installed state forms an end stop, and in the installed state telescopically encloses the supply connector unit. If the housing is moved in the direction of the supply connector unit 8, the protruding spout 17 establishes contact with the region of phase 9 of the base of the supply connector unit 8. If the distance between the complementary connector units is further reduced, the bush 17 slides in the manner of a telescope over the base of the supply connector unit 8 and in this way implements advantageous guidance of the movement which prevents tilting or incorrect positioning of the connector units. The guided movement at the same time ensures reliable positioning of the attachment means. In the present example, when the swivellable claws 2' establish contact with the stud bolts 6, as a result of guiding surfaces 18 coming into contact with the stud bolts 6, swivelling of the swivellable claws 2" against the restoring force of the tensioned spring 3 occurs. As a result of this, the claw heads can pass the stud bolts 6 if the spacing between the complementary connector units is further reduced. In an end-stop position determined by the protruding socket 17 the swivellable claws 2'" fully grip the stud bolts 6 from the back by spring-controlled engagement, as a result of which a secure mechanical connection between the housing 1 of the exit sign and the base component 5 is achieved, as is a reliable electrical connection of all contacts conducted through the complementary connector units.

FIG. 5 shows a section view of an arrangement of a housing component according to the invention, for ceiling installation, which housing component has been attached to a base component. The housing component 1 has a rounded face and a flat face. In the centre of the flat face there is a mechanism which serves to establish a disconnectable connection with a base component 5 that is installed so as to be fixed. FIG. 5 shows two stud-shaped extensions of the base component 5. This base component 5 can, for example, be attached to a frame component of a fuselage, for example, to a frame rib. The supply connector unit 8 with the supply lines 14 can also be integrated in the base component 5. In this way the base component 5 together with the supply connector unit 8 forms a component installed so as to be fixed.

The stud-shaped extensions of the base component 5 serve as a seat for the housing component 1, which is to be attached, and at the same time as a guide during installation. To this effect the housing component 1 comprises sockets 20 which make it possible to accommodate the stud-shaped extensions of the base component 5. By placing the housing component 1 with the guiding bushes 20 onto the stud-shaped extensions of the base component 5 the housing component 1 is positioned in such a way that the housing connector unit 15 that is affixed between the guiding bushes 20 is positioned opposite the supply connector unit 8. If the housing component 1 is moved in the direction of the supply connector unit 8, the housing connector unit 15 and the supply connector unit 8 engage, thus establishing the electrical connection between the base component 5 and the housing component 1.

In order to fix the housing component 1 to the base component 5, which is installed so as to be fixed, a spring mechanism is provided in the housing component 1. To this effect a locking die 22 is affixed in a chamber in such a way that it plunges into the guiding bush 20. The L-shaped locking die 22 comprises two surfaces of different length. Part of the longer first surface plunges into the guiding bush 20 at a right angle, thus forming an obstacle to the stud-shaped extension of the base component 5 during plunging into the guiding bush 20.

At a right angle to the first surface the locking platelet 22 comprises a second surface which is smaller. A pressure spring 24 acts onto this surface so that the first surface is kept in the plunged-in position. In this way the locking die 22 can only be pushed out of the interior of the guiding bush 20 by overcoming the pressure force of the pressure spring 24. Such a force can for example be exerted on the locking die 22 when the stud-shaped extension of the base component 5 is inserted. To this effect the tip of the stud-shaped extension of the base component 5 has a cone-shaped burring. This cone-shaped burring comprises an angle. An end of the locking die 22, which end plunges into the guiding bush 20, also comprises such an angle. When the stud-shaped extension of the base component 5 plunges into the guiding bush 20, the two angular surfaces establish contact, and the locking die 22 can be pushed against the pressure spring 24 from the interior of the guiding bush 20.

In a region which corresponds to the desired installation height of the housing component 1, the stud-shaped extension of the base component 5 comprises a circumferential triangular notch. This triangular notch makes possible positive locking accommodation of a tip of the part of the locking die 22 that has plunged into the guiding bush 20. As soon as the notch reaches the height of the locking die 22 the spring force of the pressure spring 24 pushes the locking die 22 into the notch. Perpendicular to the direction of movement of the housing component 1 when attached to the gudgeon-shaped extensions of the base component 5, the triangular notch has a horizontal surface which, once the locking die 22 has locked into the triangular notch, prevents the housing component 1 from sliding from the gudgeon-shaped extensions of the base component 5. As a result of this, the housing component 1 is fixed in the desired position. The plunging movement of the locking die 22 becomes possible because a chamber cover 30 and a closure strap 26 limit the movement options of the locking die 22 in the plunging movement. In FIG. 5 the closure strap 26 extends into the drawing plane. The rectangular form of the closure strap widens in the direction of the drawing plane. As a result of this, the two shorter sides of the rectangular cross section of the closure strap 26 are positioned further apart in the drawing plane. If the closure strap 26 is pushed out of the drawing plane, the locking die 22 is moved from the interior of the guiding bush 20. As a result of this, the stud-shaped extension of the base component 5 is no longer blocked by part of the locking die 22, and the housing component 1 can be withdrawn from the stud-shaped extension of the base component 5. As a result of this withdrawal the electrical connection between the base component 5 and the housing component 1 is also separated, namely by separating the supply connector unit 8 from the housing connector unit 15.

FIG. 6 shows a three-dimensional view of the closure mechanism of a housing component 1 according to FIG. 5. FIG. 6 depicts the components of the closure mechanism, which components are necessary for locking. The symmetrical arrangement of the guiding bushes 20 around the housing connector unit 15 and the corresponding symmetric arrangement of the stud-shaped extensions of the base component 5 around the supply connector unit 8 ensure that mutual engagement between the housing connector unit 15 and the supply connector unit 8 can take place. The closure strap 26 is also of symmetrical design. It comprises a longitudinal stiffener on which vertically two extensions are arranged. These extensions are of rectangular cross section. Near the longitudinal stiffener the width of the rectangular cross section enlarges. The two extensions are arranged so as to be parallel to each other. Near the longitudinal strap the distance between the rectangular extensions of the longitudinal stiffener is smaller than it is away from the longitudinal stiffener.

The arrangement in FIG. 6 shows two locking dies 22 which are pushed against the narrow sides of the rectangular extensions of the closure straps 26 by the pressure springs 24. In this position the locking dies 22 are pushed into the interior of the guiding bush 20. This is for example the case if the housing component 1 in the installed position is connected to the base component 5. Movement of the locking dies 22 is possible in the direction of the pressure springs 24. Closure countersprings 28 ensure that the closure strap 26 is kept in this position without any external force being applied.

If the housing component 1 is to be deinstalled from the base component 5, the locking dies 22 have to be removed from the interior of the guiding bushes 20. This takes place in that the closure strap 26 is pressed against the closure counterspring 28. In this way the distance between the extensions of the closure strap 26 is reduced at the height of the pressure springs 24 as a result of which the pressure springs 24 are pushed from the interior of the guiding bushes 20. Thereafter the housing component 1 can be removed out of the base component 5.

FIG. 7 shows a section view of an arrangement of a housing component, according to the invention, for wall installation, which housing component is attached to a base component. The figure shows the housing component 1 in which three quick-acting closures 36 are arranged. The quick-acting closures 36 can for example be affixed to a wall 34 by way of a quarter turn with a screwdriver on correspondingly arranged seats 32 for the quick-acting closures. By way of the position of the quick-acting closures 36 in relation to the housing connector unit 15 and the corresponding position of the seats 32 for the quick-acting closures relative to the supply connector unit 8, the housing connector unit 15 and the supply connector unit 8 are positioned exactly opposite each other and can thus engage during installation. In this way the electrical connection between the housing component 1 and a base component is established.

FIG. 8 shows a cross-section view of a housing component 1 installed on a wall. The figure shows how a quick-acting closure 36 with a seat 32 is affixed to a wall 34. The quick-acting closure 36 holds the housing component 1 to the wall. Due to the position of the quick-acting closures 36 the housing component 1 with the housing connector unit 15 arranged thereon is positioned such that the housing connector unit 15 is connected to the supply connector unit 8.

In addition it should be pointed out that "comprising" does not exclude other elements or steps, and "a" or "one" does not exclude a plural number. Furthermore, it should be pointed out that features or steps which have been described with reference to one of the above embodiments can also be used in combination with other features or steps of other embodiments described above. Reference signs in the claims are not to be interpreted as limitations.

What is claimed is:

1. An attachment system for an electrical device for installation in aircraft cabins, comprising a base component to be installed so as to be fixed, with a multi-pole supply connector unit, prepared for connection to various electrical supply lines, as a base;

attachment means affixed to the base component;

a housing component that is detachably attached for accommodating the electrical device with at least one electrical consumer;

a housing connector unit connected to the at least one electrical consumer by way of electrical lines, wherein the housing connector unit is affixed to the housing component and the housing connector unit is complementary to the supply connector unit; and further attachment means affixed to the housing component, wherein the further attachment means automatically connect to the attachment means affixed to the base component when the complementary connector units are plugged into each other, wherein the attachment means on the base component comprise stud bolts on both sides of the base component, whose axes extend across the plug-in direction of the housing component, and wherein the further attachment means on the housing component comprise claws on both sides of the housing component that are swivellable, and wherein the claws mate with the bolts at one end of the claws, wherein the claws are configured to be swivelled away against a restoring force of a stretched spring connecting the claws at another end of the claws.

2. The attachment system of claim 1, wherein the attachment means are suitable for establishing a positive locking connection.

3. The attachment system of claim 1, wherein the attachment means on the base component comprise a fixed contour that can be gripped from the back.

4. The attachment system of claim 1, wherein the housing connector unit comprises a protruding spout which, when the complementary connector units are plugged into each other during installation, guides of the movement of the housing component, in the installed state forms an end stop, and telescopically encloses the supply connector unit.

5. The attachment system of claim 1, wherein in the installed state the stretched spring keeps the swivellable claws engaged with the stud bolts.

6. The attachment system of claim 5, wherein in the installed state the swivellable claws completely grip the stud bolts from the back, and for undoing the for removing from the housing component by unlocking of the connection between the stud bolts and the claws has to take place.

7. The attachment system of claim 5, wherein the swivellable claws in the installed state grip the stud bolts from the back, and removal from the housing component by applying a force above a specified pull-off force causes automatic unlocking of the connection between the stud bolts and the claws.

8. The attachment system of claim 1, wherein the complementary connector units are designed in two rows and incorporate at least eight poles.

9. The attachment system of claim 1, wherein the housing component is an exit sign.

* * * * *